US006881179B2

(12) United States Patent
Mostardi

(10) Patent No.: US 6,881,179 B2
(45) Date of Patent: Apr. 19, 2005

(54) INFLATABLE POLYHEDRAL EXERCISE DEVICE

(75) Inventor: Richard Mostardi, Ravenna, OH (US)

(73) Assignee: FitMetrics Associates Limited, Hudson, OH (US)

( * ) Notice: Subject to any disclaimer, the term of this patent is extended or adjusted under 35 U.S.C. 154(b) by 317 days.

(21) Appl. No.: 10/303,561

(22) Filed: Nov. 25, 2002

(65) Prior Publication Data

US 2004/0102293 A1 May 27, 2004

(51) Int. Cl.[7] ..... A63B 21/00
(52) U.S. Cl. ..... 482/91; 482/44; 482/49
(58) Field of Search ..... 482/77, 121–123, 482/126, 44–49, 91; 273/457, 458; 434/138; 473/596, 597, 593, 610, 611

(56) References Cited

U.S. PATENT DOCUMENTS

| | | | | |
|---|---|---|---|---|
| 777,478 | A | | 12/1904 | Minor |
| 1,628,717 | A | | 5/1927 | Flowers |
| 2,115,926 | A | | 5/1938 | Hatton |
| 2,718,644 | A | | 9/1955 | Barr |
| 4,023,808 | A | | 5/1977 | Hebert |
| 4,376,533 | A | | 3/1983 | Kolbel |
| 4,406,453 | A | | 9/1983 | Herzfeld |
| 4,852,874 | A | | 8/1989 | Sleichter, III et al. |
| 5,145,473 | A | | 9/1992 | Henry ..... 482/49 |
| 5,242,348 | A | | 9/1993 | Bates ..... 482/105 |
| 5,630,777 | A | | 5/1997 | Garren et al. ..... 482/121 |
| 5,713,816 | A | | 2/1998 | Glover ..... 482/10 |
| 5,735,776 | A | | 4/1998 | Swezey et al. ..... 482/91 |
| 5,810,700 | A | | 9/1998 | Orcutt |
| 6,062,289 | A | | 5/2000 | Cunningham et al. |
| 6,068,580 | A | | 5/2000 | Myers et al. |
| 6,322,107 | B1 | * | 11/2001 | Lieberman ..... 283/2 |
| 6,328,675 | B1 | | 12/2001 | Kaye |
| 6,547,703 | B1 | * | 4/2003 | Swezey et al. ..... 482/91 |
| 6,572,499 | B1 | * | 6/2003 | Davies ..... 473/604 |
| 6,726,582 | B1 | * | 4/2004 | Kuo et al. ..... 473/604 |

* cited by examiner

*Primary Examiner*—Glenn Richman
(74) *Attorney, Agent, or Firm*—Renner, Kenner Greive, Bobak, Taylor & Weber

(57) ABSTRACT

A soft, durable, inflatable, exercise device, preferably trapezoidal in shape is provided to enable a user to apply compressive isometric forces against the device to train, strengthen and/or condition major muscles and muscle groups of the human body.

33 Claims, 2 Drawing Sheets

INFLATABLE POLYHEDRAL EXERCISE DEVICE

TECHNICAL FIELD

This invention relates generally to a flexible, portable exercise device. More particularly, the present invention relates to a polyhedral-shaped, inflatable exercise device with at least one face of the device having the shape of a trapezoid. The device of the present invention facilitates the strengthening and maintenance of muscles and related joints through a series of uniquely and specifically designed exercises.

BACKGROUND OF THE INVENTION

The need for resistance exercise has become increasingly apparent in this country. Non use of the muscular and skeletal systems has produced chronic de-conditioning and reduced fitness levels, making people more susceptible to musculoskeletal injuries. In addition it has been recognized that regular resistance exercise over the course of a lifetime is necessary to prevent the loss of muscle tissue and, thus, to maintain the strength and endurance of the musculoskeletal system. This injury-preventing formula has great relevance to middle-aged persons and is critical for older populations, where weak muscles produce weak joints and bones. Muscular weakness increases the incidence of falls, and can lead to a plethora of orthopaedic problems.

Additionally, it has been shown that to effectively counter obesity in humans, there are three essentials which generally should be undertaken by the person to lose weight. The first essential is to reduce caloric intake. The second essential is aerobic (endurance) training. The third essential is anaerobic (resistance) training. Any exercises or devices that aid in such endurance or resistance training are believed desirable to the weight loss community.

Resistance exercise can take two basic forms: isotonic and isometric. With isotonic exercises, the joints and appendages of the body lift a weight and move it through space. Commonly called weight lifting, this is a very popular resistance exercise modality. However, there are drawbacks concerning equipment and injury. First, it is necessary to have a selection of weights to conform to different users and to different resistance exercises. Second, because the weights are moved through space, muscle and limb control can be lost and injuries can result. These two factors make weight lifting inconvenient for a large population of users and without proper instruction, it can be dangerous.

Isometric exercise is the second form of resistance exercise. With this modality, the body remains in a relatively fixed and stable position in space while force is exerted against a fixed object, structure, or against the exerciser's body itself. It has been proven in many studies that muscle exertion while flexed even over a short range of motion can provide excellent muscle-conditioning results. Typical isometric exercises are very safe and fundamentally involve the application of force against an object that resists the applied force.

It is generally known that isometric exercise is less damaging to muscles than isotonic exercise inasmuch as there is no possibility of dropping weights or overextending muscles or joints. It is further generally known that isometric exercise, when properly performed, has the benefits of strengthening and conditioning the musculoskeletal system.

Thus, there is a need in the exercise industry for a device suitable for conducting a variety of isometric exercises which will enable the exerciser to strengthen and condition most, if not all, of the major muscles and muscle groups of the human body. Unlike free weights and many other types of equipment, it is nearly impossible for the device of the present invention to injure the user or bystanders, or to be damaged by improper use.

SUMMARY OF INVENTION

Broadly, the present invention relates to a lightweight, portable, flexible exercise device ergonomically adapted to exercise the major muscles of the human body. The exercise device of the present invention has a polyhedral shape and is ergonomically designed so that it conforms to the human body during execution of isometric exercises. This ensures comfortable, resistive force generation so that any of a number of exercises, including but not limited to some specifically designed isometric exercises as described below, can be carried out, and eliminates various, less conforming designs such as round (spherical) balls and square blocks.

The advantages of the present invention over the known art relating to isometric exercise devices, which shall become apparent from the description and drawings that follow, are accomplished by the invention as hereinafter described and claimed.

In general, one or more aspects of the invention may be accomplished by an exercise device comprising an inflatable bladder taking a shape, when inflated, of a six-sided polyhedron defined essentially by a rectangular base, parallel to and larger than a rectangular top; a first pair of opposing trapezoidal walls, attached to the base at a first angle less than 90°, and; a second pair of opposing trapezoidal walls comprising a first regular trapezoid disposed at a second angle less than 90° to the base, and a second regular trapezoid, disposed at a third angle less than 90° to the base.

Other aspects of the invention may be achieved by an exercise device having a shape of essentially a six-sided polyhedron, comprising an inflatable bladder defined by a first pair of opposing rectangular parallel walls, a second pair of opposing walls comprising trapezoids, and; a third pair of opposing walls comprising trapezoids.

Still other aspects of the invention may be achieved by an exercise device comprising a inflatable bladder, the inflatable bladder being defined by a first pair of opposing rectangular parallel walls, one of which is larger than the other; a second pair of opposing side walls comprising irregular trapezoids of the same area, each disposed at an angle less than 90° to the larger parallel wall, and; a third pair of opposing end walls comprising a first regular trapezoids disposed at a first angle less than 90° to the larger parallel wall, and a second regular trapezoid, disposed at a second angle less than 90° to the larger parallel wall.

Another embodiment of the present invention provides for a method of conducting isometric exercises comprising: providing an inflated exercise device wherein the device comprises a rectangular base having a length corresponding to a first range of muscle contraction and exceeding its width, corresponding to a second range of muscle contraction, parallel to and larger than a rectangular top having a length exceeding its width, a first pair of opposing trapezoidal walls comprising a first trapezoid attached along the length of the base at a first angle less than 90°, and; a second trapezoid attached along the length of the base at a second angle less than 90°, a second pair of opposing trapezoidal walls comprising a third trapezoid attached along the width of the base at a third angle less than 90°, and; a fourth trapezoid attached along the width of the base at a fourth angle less than 90°, wherein the first and second angles may be the same and the third and fourth angles are different; contacting a first opposing wall to a first sub-part of a user's body; contacting a second opposing wall to a second sub-part of the user's body, separated from the first sub-part by one or more joints, and; contracting repeatedly muscles associated with the involved sub-parts and joints of the user's body in a range of muscle contraction so as to exert pressure on the device and thereby cause a reactive force to work against the muscles.

Yet another embodiment of the present invention provides a method of conducting isometric exercises comprising: providing an inflated exercise device wherein the device comprises a rectangular base having a length corresponding to a first range of muscle contraction and exceeding its width, corresponding to a second range of muscle contraction, parallel to and larger than a rectangular top having a length exceeding its width, a first pair of opposing trapezoidal walls comprising a first trapezoid attached along the length of the base at a first angle less than 90°, and; a second trapezoid attached along the length of the base at a second angle less than 90°, a second pair of opposing trapezoidal walls comprising a third trapezoid attached along the width of the base at a third angle less than 90°, and; a fourth trapezoid attached along the width of the base at a fourth angle less than 90°, wherein the first and second angles may be the same and the third and fourth angles are different; contacting a first opposing wall to a first bilaterally symmetrical part of a user's body; contacting a second opposing wall to a second bilaterally symmetrical part of the user's body, and; contracting repeatedly muscles associated with the involved bilaterally symmetrical parts of the user's body in a range of muscle contraction so as to exert pressure on the device and thereby cause a reactive force to work against the muscles.

Still a further embodiment of the present invention provides a method of conducting isometric exercises comprising: providing an inflated exercise device wherein the device comprises a rectangular base having a length corresponding to a first range of muscle contraction and exceeding its width, corresponding to a second range of muscle contraction, parallel to and larger than a rectangular top having a length exceeding its width, a first pair of opposing trapezoidal walls comprising a first trapezoid attached along the length of the base at a first angle less than 90°, and; a second trapezoid attached along the length of the base at a second angle less than 90°, a second pair of opposing trapezoidal walls comprising a third trapezoid attached along the width of the base at a third angle less than 90°, and; a fourth trapezoid attached along the width of the base at a fourth angle less than 90°, wherein the first and second angles may be the same and the third and fourth angles are different; contacting a first opposing wall to a bilaterally symmetrical part of a user's body; contacting a second opposing wall along the length of the base to an immovable object, and; contracting repeatedly muscles associated with the involved bilaterally symmetrical part of the user's body in a range of muscle contraction in the direction of the immovable object so as to exert pressure on the device and thereby cause a reactive force to work against the muscles.

Yet a further embodiment of the present invention provides a method of conducting isometric exercise comprising: providing an inflated trapezoidal-polyhedral exercise device; contacting a first opposing side of the device to a first bilaterally symmetrical part of a user's body; contacting a second opposing side of the device to a second bilaterally symmetrical part of the user's body, and; exerting a muscular force on the device using the two bilaterally symmetrical parts of the user's body and holding such force for a predetermined time.

Still a further embodiment of the present invention provides a method of conducting isometric exercises comprising: providing an inflated exercise device wherein the device comprises a rectangular base having a length corresponding to a first range of muscle contraction and exceeding its width, corresponding to a second range of muscle contraction, parallel to and larger than a rectangular top having a length exceeding its width, a first pair of opposing trapezoidal walls comprising a first trapezoid attached along the length of the base at a first angle less than 90°, and; a second trapezoid attached along the length of the base at a second angle less than 90°, a second pair of opposing trapezoidal walls comprising a third trapezoid attached along the width of the base at a third angle less than 90°, and; a fourth trapezoid attached along the width of the base at a fourth angle less than 90°, wherein the first and second angles may be the same and the third angle is smaller than the fourth angle; contacting the side attached to the base at the third angle to a user's shoulder blades; contacting the user's buttocks and feet to the floor; repeatedly raising the buttocks off the floor, leaving the shoulder blades in contact with the device and the feet in contact with the floor.

PREFERRED EMBODIMENTS FOR CARRYING OUT THE INVENTION

Figure 1:
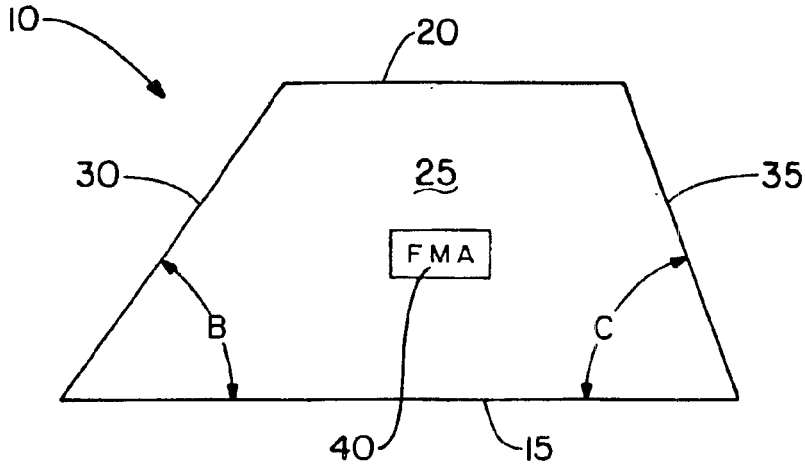
FIG. 1 is a schematic representation of a side view of the device of the present invention.

As noted hereinabove, the present invention is directed toward an inflatable device or bladder having the shape, when inflated, essentially of a six-sided polyhedron defined by a rectangular base, parallel to and larger than a rectangular top, a first pair of opposing trapezoidal walls, attached to the base at a first angle less than 90°, and a second pair of opposing trapezoidal walls comprising a first regular trapezoid disposed at a second angle less than 90° to the base, and a second regular trapezoid, disposed at a third angle less than 90° to the base. The device has been specifically designed to conform comfortably to the human body during resistance (isometric) exercises.

It will be appreciated that the polyhedron shape is the general shape of the device. Since the device is inflatable and the walls of the device are made of thin plastic or rubber materials, the walls of the device will expand or balloon to some extent. Thus, while the present description discussed the general shape of the device and angle associated with the shape of the device, it will be understood that these angles and shapes are of a general nature and set forth as if the walls of the device were rigid upon inflation. It is entirely possible that, upon extreme inflation for example, the walls of the device may bulge and have angles greater than 90° at the point of connection of one wall with another. As discussed hereinbelow, ribs may be used to curtail the bulging of the device to some extent.

It will be further appreciated that where angles are set forth in this specification, they are set forth as if the device has the proper amount of air not to expand the sides outwardly beyond a plane between the edges thereof.

One embodiment of the device provides a soft, inflatable, ergonomically-designed, trapezoid-shaped device. The device is preferably made from a suitably strong, yet flexible, plastic material, measuring about nineteen (19) inches long, about nine (9) inches high and about eleven (11) inches wide. It will be appreciated, however, that any size device which can be comfortably used for resistive exercise may be used, provided the device maintains a general polyhedral, and preferably, trapezoidal, shape.

The device may be used with any known isometric exercises, but is particularly suited for use in conjunction with a sequence of at least eleven (11) uniquely designed isometric exercises, where resistance is offered against the device. Using the device with these exercises allows for all of the major muscles and muscle groups of the human body to be strengthened, conditioned and better equipped to accept the forces applied during daily living.

Referring to the drawings, FIGS. 1–4 illustrate one schematic representation of the exercised device of the present invention. This embodiment is for illustrative purposes only and should not be viewed as the only embodiment of the device, the scope of the invention being determined by the spirit and limitations of the claims.

Figure 2:
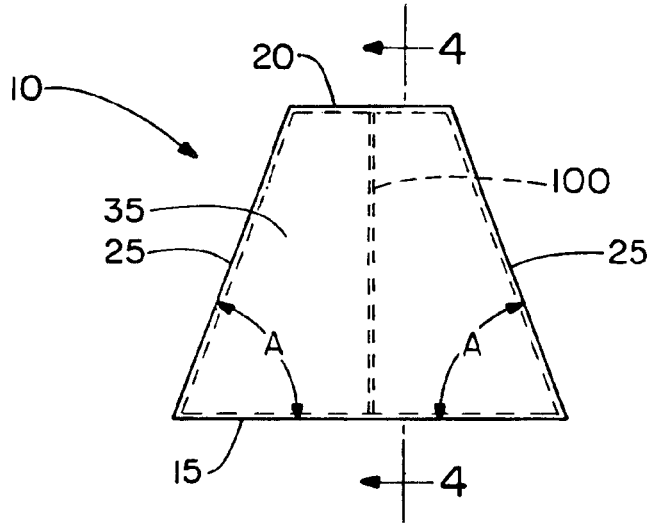
FIG. 2 is a schematic representation of an end view of the device of the present invention.

One representative form of the exercise device of the present invention is denoted generally by the numeral 10 in FIGS. 1 and 2. Exercise device 10 comprises an inflatable bladder having the shape, when inflated, essentially of a six-sided polyhedron. The polyhedron is defined essentially by a rectangular base 15, parallel to and larger than a rectangular top 20; a first pair of opposing trapezoidal walls 25, each attached to the base 15 at a first angle A less than 90° as shown in FIG. 2; and a second pair of opposing trapezoidal walls comprising a first regular trapezoid 30 disposed at a second angle B less than 90° to the base 15, and a second regular trapezoid 35, disposed at a third angle C less than 90° to the base 15. Inasmuch as walls 25 lie along the length (major dimension) of the device, and walls 30 and 35 lie along the width (minor dimension) of the device, walls 25 may be referred to as "long faces" and walls 30 and 35 may be referred to as "short faces".In one embodiment of the present invention, angle A is from about 60° to about 80°, angle B is from about 40° to about 70°, and angle C is from about 60° to about 80°. For convenience, the device has been described and depicted as if an idealized polyhedron having flat sides joined at specific angles. In practice, the flexure of the device owing to air pressure and use during exercise will cause the angles and dimensions to vary slightly from the idealized values. Such variations are contemplated and within the scope of the invention. In another embodiment the exercise device 10 will have the first angle A about 70°, the second angle B about 55° and the third angle C about 70°.

The exercise device 10 may be composed of plastic or rubber. Examples of plastics useful in the practice of the present invention include polypropylene, polyethylene and polyvinyl chloride; polyamides such as nylon 6,6, and nylon 6,12; and polyurethane foam. Typically, the device is made by extrusion or other manufacturing techniques which provide for the forming of a thin flexible sheet of material which can be cut or otherwise formed into the walls of the device. The walls may then be attached to each other by any manner known in the art. For example, the walls may be glued together, sewn together, heat-welded together or sonic-welded together. The exact type of attachment of one wall to another will depend on the composition of the walls. Further, the exercise device 10 of the present invention may have indicia 40 printed on any or all sides of the device.

Figure 3:
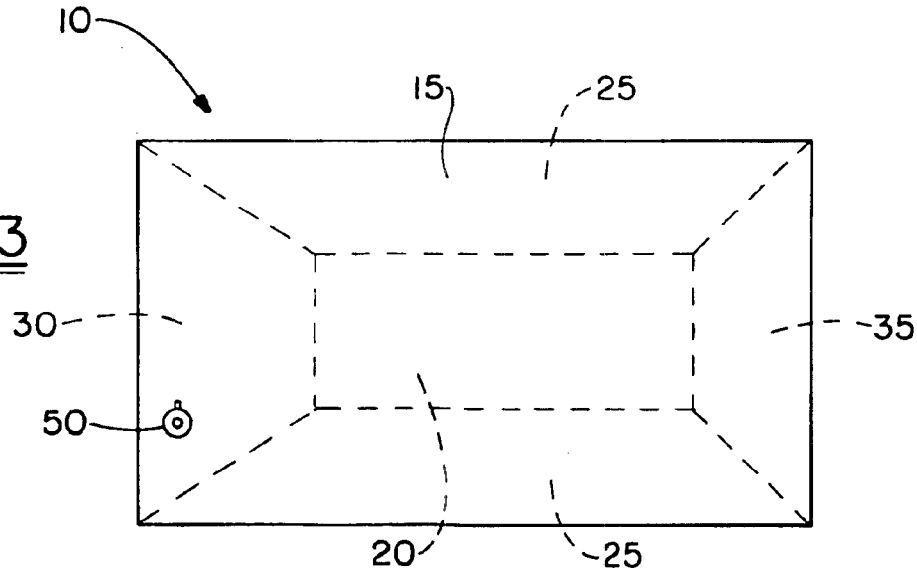
FIG. 3 is a schematic representation of the bottom (base) view of the device of the present invention.

Referring now to FIG. 3, the exercise device may have a valve 50 to allow for the ingress and egress of air into and out of the device for inflation and deflation. It will be appreciated that the length of the base 15 is preferably from about 1 to about 2.5 times the width of the base 15. In another embodiment, the length of the base 15 may be from about 1.3 to about 2.1 times the width of the base 15. In still another embodiment the length of the base 15 may be from about 1.7 to about 2.3 times the length of the top 20, shown in phantom.

Figure 4:
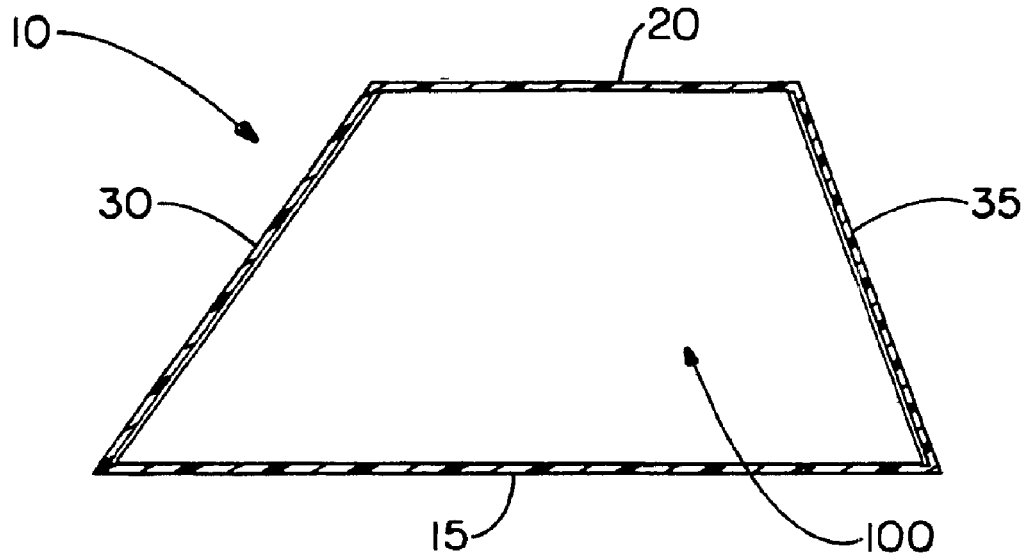
FIG. 4 is a cross-sectional view of the device of the present invention taken along the line 4—4 in FIG. 2.

Referring to FIG. 4, it may be seen that the exercise device 10 may include one or more internal ribs 100 extending between the base 15 and the top 20, located within the bladder so as to maintain the general polyhedral, preferably trapezoidal, shape of the device 10. The ribs 100 are more rigid than the thin sheet material forming the walls, and preferably take a trapezoidal shape similar to that of the first pair of trapezoidal walls 25. Each rib 100 is preferably attached to the top 20 along essentially its entire length and attached to the base 15 along essentially its entire length such that the top 20 and base 15 are maintained generally parallel to each other with the top 20 substantially centered on the base 15. In one embodiment, the ribs of the exercise device of the present invention comprises a series of reinforcing strips each having a width from about 1/50 to about 1/20 of the length of the base and the spaces between said strips may be from about 1/100 to about 1/50 of the length of the base.

As a further embodiment, one or more ribs 100 of the exercise device 10 may, in the alternative, provide one or more internal walls which separate the bladder into two or more air-tight compartments. In such case, each air-tight compartment will have a valve to allow the ingress and egress of air for inflation and deflation of the bladder.

A further embodiment of the present invention includes an exercise device having the shape essentially of a six-sided polyhedron, comprising an inflatable bladder defined by a first pair of opposing rectangular parallel walls; a second pair of opposing walls comprising trapezoids, and; a third pair of opposing walls comprising trapezoids. Preferably, one of the first pair of opposing rectangular parallel walls is larger than the other. The second pair of opposing side walls are preferably identical in surface area and comprise irregular trapezoids. In a preferred embodiment, each wall of the second pair of walls is disposed at an angle less than 90° to the larger parallel wall. The third pair of opposing end walls includes a first regular trapezoid-shaped wall 30 disposed at a first angle less than 90° to the larger parallel wall, and a second regular trapezoid wall 35, disposed at a second angle less than 90° to the larger parallel walls.

As earlier noted, a plurality of images or other indicia may be printed on one or more walls of the device, such as, for example, representations of exercises that may be performed with the device, for ease of use. The exercise device may further comprise an absorbent cover (not shown) or other material capable of being removably applied to the device either by attachment or be slipping it on like a pillow case, which absorbs the perspiration of the user. The absorbent cover may also contain indicia printed on the cover.

It will be appreciated that the present invention eliminates the need for complicated and expensive equipment. The device is relatively soft and comfortable so isometric exercises can be performed without irritating or injuring the user. The polyhedral shape is ergonomically designed so that it conforms to the human body during execution of isometric exercises. Further, the device is safe to use in that it does not require springs, stretch cords, or other mechanical attachments. When such springs, stretch cords, or mechanical levers or arms break or function defectively, they can injure the user. It is envisioned that the device can been developed in a manner such the it is sufficiently durable and strong to withstand the normal compressive forces that a typical user might exert over a device life span of at least five (5) years.

The device is easily inflated by mouth, and can be stored in small places upon deflation. The bladder pressure that can be attained by the ordinary person inflating the device by blowing air into it is sufficient to provide resistance which will aid in isometric training of all major muscles and muscle groups. The device is envisioned to serve all age groups, specifically to strengthen and develop muscles and associated joints of youthful exercisers, to develop and maintain strength of muscles and assorted joints of middle-aged exercisers, and to prevent deterioration and maintain muscles and associated joints of elderly exercisers.

In accordance with an embodiment of the present invention, at least eleven (11) isometric exercises are provided, which have been designed to activate all of the major muscles and muscle groups of the body. The exercises are provided hereinbelow. A daily regimen of these exercises employing both the long and short faces of the device will provide strength and endurance training to the muscles of the body. Research studies have shown that such muscular exercises result in a number of positive changes, including: (1) an increase in muscles' ability to mobilize, deliver and consume body fat; (2) an increase in blood flow and circulation; (3) an increase in both strength and endurance; (4) an increase in the strength of connective tissue (tendons, ligaments and joints); (5) an increase in musculoskeletal efficiency of daily movements, and; (6) an overall feeling of physical and psychological well-being.

The eleven isometric exercises provide resistive training to all of the major muscles and muscle groups. Additionally, given the shape of the device, there is a major dimension, (length, e.g., 19 inches) and minor dimension (width, e.g., 11 inches), which provides for two (2) ranges of muscle contraction in the isometric exercises. The various sizes of the sides and angles therebetween facilitate the practice of a number of isometric exercises, which train and strengthen all major muscles and muscles groups of the body.

The isometric exercises come in two general types. A first type is compression of the device between two bilaterally symmetrical parts of the body, such as two legs or two arms. A second type of isometric exercise is compression of the device between two subparts of the body separated by one or more joints. An example of this is compression of the device between the upper arm and forearm so as to train the biceps, or compression of the device between the upper and lower leg, so as to train the thigh. A third type of isometric exercise is compression of the device between a body part and an immovable object or surface, such as a tree or the wall of a building. An example of this is compression of the device between the user's tibia and a building wall by sitting in a chair and extending the quadriceps in an effort to straighten the leg.

The eleven (11) isometric exercises are demonstrated by the following examples. The scope of the invention is not limited to these examples, as many other exercises may be performed therewith. Only the claims serve to define the scope of the invention.

Example 1

Seated Crunch against device (Spine Flexion)

The user sits in a chair such that his upper legs are parallel to the floor. He places the device 10 in his lap, with either long face 25 or short face 30 contacting his upper legs. The user contracts his abdominal muscles and squeezes the device. With this exercise, the major emphasis is on the Latisimus Dorsi, while the Pectoralis, Deltoids and Biceps also contribute to stabilize the device. Alternatives to this Seated Crunch are the Squat Crunch and the Bending Crunch. In the former, the user stands holding the device as above, with the legs bent so as to form a squatting position, and the user contracts his abdominal muscles as above. The Squat Crunch also trains the Gluteal Muscle group. The user can alternatively bend at the waist holding the device substantially as above. In such case, the Erector Spinae (back muscles) are also trained.

Example 2

Rump-Up Exercise (Spine Extension)

The user places the device 10 with its base 15 down on the floor. He lies on the floor with knees bent, feet and buttocks on the floor and with only his shoulder blades contacting the device on the side forming the 55° angle with the base. The exercise consists of the user raising and lowering the buttocks by contracting the Erector Spinae and Gluteus muscles.

Example 3

Arm-Shoulder Adduction and Scapular Elevation

The user places the device 10 with either long face 25 or short face 30 contacting the back side of his lower arm, and the base 15 facing generally upward. The user holds the device against a wall or immovable object and exerts muscular force upward and outward. This exercise trains the Supraspinatus, the Trapezium, the Levator Scapular muscle, the Serratus Anterior, and the Deltoids. The height at which the device is placed relative to the user's height will serve to train the aforementioned muscles over a wide range of flexion and contraction. Both arms can be so trained.

Example 4

Arm-Shoulder Adduction

The user places the device between his forearm and side with the top 20 facing upward. The user may contact either a long face 25 or a short face 30, 35 to his body. The user then exerts force inward such that the device is compressed between his arm and his abdomen. This exercise trains the Biceps, Pectoralis Major, Latisimus Dorsi, Teres Major and Deltoids. Both arms can be so trained.

Example 5

Forward/Medial Arm Press

The user, either seated or standing, with his arms forward, about parallel to the floor, grasps the device 10, with either long faces 25 or short faces 30, 35 between the palms of his hands. The user exerts force inward such that the device is compressed between his hands. In this way, the Pectoralis Major and Minor, the Coracobrachialis, the Deltoids, the Biceps, the Latisimus Dorsi, and the wrist, hand and digit flexors are trained. Holding long faces 25 will train the Pectoralis at a shorter contraction range, while holding short faces 30, 35, will train the Pectoralis at a longer contraction range.

Example 6

Upper/Medial Arm and Shoulder Press

The user, either seated or standing, performs substantially the same actions as in Example 5, except that the arms are held generally over the head, so that the user's arms and legs form about a 130° angle. This position, not directly overhead, reduces shoulder strain and minimizes injuries. This exercise trains the upper back and shoulder musculature, Latisimus Dorsi, Upper Trapezium, Rhomboids, Coracobrachiatus, Pectoralis Major, and Levator Scapula.

Example 7

Forearm and Hand Curl

The user, either seated or standing, holds the device 10 in the crook of the elbow, with either the long faces 25 or the short faces 30, 35, contacting his chest and forearm, respectively. The user exerts force with the arm so as to compress the device between the forearm and upper arm. This exercise trains the Biceps, Brachialis, Brachioradialis, wrist, hand and finger flexors.

Example 8

Leg Extension and Thigh Flexion

The user is seated on a chair or other item which provides back support and is tall enough to allow his legs to swing freely without touching the floor. The user contacts either the long face 25 or a short face 30, 35 on his tibia, and holds it up against a wall or other immovable object. The user extends his legs so as to compress the device up against the wall. This exercise trains the Quadriceps, (Vastus Lateralis, Medialis, Intermedium, Rectus Femoris), Tensor Facie Latae, and Iliopsoas. The distance at which the User sits from the wall can, when adjusted will serve to train the aforementioned muscles over a wide range of flexion and contraction. The legs can be so trained together or individually.

Example 9

Leg and Thigh Adduction

The user is seated on a chair or other item which provides back support and is tall enough to allow his legs to swing freely without touching the floor. The user holds the device between the legs, at the level of the knee, with either the long face 25 or a short face 30, 35. The user exerts inward force (adduction) so as to compress the device between the knees. This exercise trains the Adductors (Longus, Brevis, and Magnus), Pectineus, Gracilis, and Sartorius.

Example 10

Leg Flexion and Thigh Extension

The user is seated on a chair or other item, which provides back support and is tall enough to allow his legs to swing freely without touching the floor. The user contacts either the long face 25 or a short face 30, 35 to his calves, and holds the device against the base of the chair upon which he sits. The user exerts force on the device with his legs so as to compress the device in the direction of the chair. This exercise trains the Hamstrings, (Semitendenosis, Semimembranosis, Biceps Femoris), Gluteus Maximus, Sartorius and Gracilis. The legs can be so trained together or individually.

Example 11

Hip Flexor

The user is seated on a chair or other item which provides back support. The user positions the devise 10 with the base positioned on the thigh and the hand and forearm of the same side of the body on the top 20. Simultaneously the user raises the thigh against the base 15 and lowers the forearm against the top 20. In this way the hip flexors (Psoas, Iliacus, and Tensor Facie Latae) are trained. Both sides of the hip flexors can be so trained.

Thus it should be evident that the device and methods of the present invention are highly effective in providing resistive exercise and training to strengthen and condition major muscles and muscle groups of the human body. The invention is particularly suited for isometric exercise, but is not necessarily limited thereto. The device and method of the present invention can be used separately with other equipment, methods and the like, without necessarily departing from the scope and spirit of the invention.

Based upon the foregoing disclosure, it should now be apparent that the use of the device described herein will carry out the objects of the present invention. It is, therefore, to be understood that any variations evident fall within the scope of the claimed invention and thus, the selection of specific component elements or exercises can be determined without departing from the spirit of the invention herein disclosed and described. Thus, the scope of the invention shall include all modifications and variations that may fall within the scope of the attached claims.

What is claimed is:

1. An exercise device comprising an inflatable bladder, having essentially a shape when inflated, of a six-sided polyhedron defined by:

a rectangular base, parallel to and larger than a rectangular top;

a first pair of opposing trapezoidal walls, attached to the base at a first angle less than 90°, and;

a second pair of opposing trapezoidal walls comprising a first regular trapezoid disposed at a second angle less than 90° to the base, and a second regular trapezoid, disposed at a third angle less than 90° to the base.

2. The exercise device of claim 1, wherein the first angle is about 70°, the second angle is about 70°, and the third angle is about 55°.

3. The exercise device of claim 1, wherein the device is made of a material selected from the group consisting of synthetic rubbers and plastics.

4. The exercise device of claim 1, wherein indicia are printed on the device.

5. The exercise device of claim 1, further comprising an absorbent cover which absorbs perspiration of the user.

6. The exercise device of claim 5, wherein indicia are printed on the absorbent cover.

7. The exercise device of claim 1, wherein the walls are glued together.

8. The exercise device of claim 1, wherein the walls are sewn together.

9. The exercise device of claim 1, wherein the walls are heat welded together.

10. The exercise device of claim 1, wherein the walls are sonic welded together.

11. The exercise device of claim 1, further comprising a valve to allow the ingress and egress of air for inflation and deflation.

12. The exercise device of claim 1, wherein the length of the base is from 1.0 to 2.5 times the width of the base.

13. The exercise device of claim 12, wherein the length of the base is from 1.3 to 2.1 times the width of the base.

14. The exercise device of claim 13 wherein the length of the base is from 1.7 to 2.3 times the length of the top.

15. The exercise device of claim 1, further comprising one or more internal ribs extending between the base and the top, located within the bladder.

16. The exercise device of claim 15 wherein said ribs comprise a reinforcing material having a trapezoidal shape.

17. The exercise device of claim 16 wherein said ribs are attached to the top along essentially its entire length and which is attached to the base along essentially its entire length.

18. The exercise device of claim 1, further comprising at least one internal wall separating the bladder into at least two air tight compartments.

19. The exercise device of claim 18 wherein each air tight compartment has a valve to allow the ingress and egress of air for inflation and deflation.

20. An exercise device having the shape of essentially a six-sided polyhedron, comprising an inflatable bladder defined by:

a first pair of opposing rectangular parallel walls;

a second pair of opposing walls comprising trapezoids, and;

a third pair of opposing walls comprising trapezoids.

21. An exercise device comprising a inflatable bladder defined by:

a first pair of opposing rectangular parallel walls, one of which is larger than the other;

a second pair of opposing side walls comprising irregular trapezoids of the same area, each disposed at an angle less than 90° to the larger parallel wall, and;

a third pair of opposing end walls comprising a first regular trapezoids disposed at a first angle less than 90° to the larger parallel wall, and a second regular trapezoid, disposed at a second angle less than 90° to the larger parallel wall.

22. A method of conducting isometric exercises comprising:

providing an inflated exercise device wherein the device comprises a rectangular base having a length corresponding to a first range of muscle contraction and exceeding its width, corresponding to a second range of muscle contraction, parallel to and larger than a rectangular top having a length exceeding its width, a first pair of opposing trapezoidal walls comprising a first trapezoid attached along the length of the base at a first angle less than 90°, and;

a second trapezoid attached along the length of the base at a second angle less than 90°, a second pair of opposing trapezoidal walls comprising a third trapezoid attached along the width of the base at a third angle less than 90°, and;

a fourth trapezoid attached along the width of the base at a fourth angle less than 90°, wherein the first and second angles may be the same and the third and fourth angles are different;

contacting a first opposing wall to a first sub-part of the user's body;

contacting a second opposing wall to a second sub-part of the user's body, separated from the first sub-part by one or more joints, and;

contracting repeatedly the muscles associated with the involved sub-parts and joints of the user's body in a range of muscle contraction so as to exert pressure on the device and thereby cause a reactive force to work against said muscles.

23. The method of claim 22 wherein the first and second opposing walls are along the width of the base and the range of muscle contraction is the first range.

24. The method of claim 22 wherein the first and second opposing walls are along the length of the base and the range of muscle contraction is the second range.

25. A method of conducting isometric exercises comprising:

providing an inflated exercise device wherein the device comprises a rectangular base having a length corresponding to a first range of muscle contraction and exceeding its width, corresponding to a second range of muscle contraction, said base parallel to and larger than a rectangular top having a length exceeding its width, a first pair of opposing trapezoidal walls comprising a first trapezoid attached along the length of the base at a first angle less than 90°, and;

a second trapezoid attached along the length of the base at a second angle less than 90°, a second pair of opposing trapezoidal walls comprising a third trapezoid attached along the width of the base at a third angle less than 90°, and;

a fourth trapezoid attached along the width of the base at a fourth angle less than 90°, wherein the first and second angles may be the same and the third and fourth angles are different;

contacting a first opposing wall to a first bilaterally symmetrical part of the user's body;

contacting a second opposing wall to a second bilaterally symmetrical part of the user's body, and;

contracting repeatedly the muscles associated with the involved bilaterally symmetrical parts of the user's body in a range of muscle contraction so as to exert pressure on the device and thereby cause a reactive force to work against said muscles.

26. The method of claim 25 wherein the first and second opposing walls are along the width of the base and the range of muscle contraction is the first range.

27. The method of claim 25 wherein the first and second opposing walls are along the length of the base and the range of muscle contraction is the second range.

28. A method of conducting isometric exercises comprising:

providing an inflated exercise device wherein the device comprises a rectangular base having a length corresponding to a first range of muscle contraction and exceeding its width, corresponding to a second range of muscle contraction, said base parallel to and larger than a rectangular top having a length exceeding its width, a first pair of opposing trapezoidal walls comprising a first trapezoid attached along the length of the base at a first angle less than 90°, and;

a second trapezoid attached along the length of the base at a second angle less than 90°, a second pair of opposing trapezoidal walls comprising a third trapezoid attached along the width of the base at a third angle less than 90°, and;

a fourth trapezoid attached along the width of the base at a fourth angle less than 90°, wherein the first and second angles may be the same and the third and fourth angles are different;

contacting a first opposing wall to a bilaterally symmetrical part of the user's body;

contacting a second opposing wall along the length of the base to an immovable object, and;

contracting repeatedly the muscles associated with the involved bilaterally symmetrical part of the user's body in a range of muscle contraction in the direction of the immovable object so as to exert pressure on the device and thereby cause a reactive force to work against said muscles.

29. The method of claim 28 wherein the first and second opposing walls are along the width of the base and the range of muscle contraction is the first range.

30. The method of claim 28 wherein the first and second opposing walls are along the length of the base and the range of muscle contraction is the second range.

31. A method of conducting isometric exercises comprising:

providing an inflated exercise device wherein the device comprises a rectangular base having a length corresponding to a first range of muscle contraction and exceeding its width, corresponding to a second range of muscle contraction, said base parallel to and larger than a rectangular top having a length exceeding its width, a first pair of opposing trapezoidal walls comprising a first trapezoid attached along the length of the base at a first angle less than 90°, and;

a second trapezoid attached along the length of the base at a second angle less than 90°, a second pair of opposing trapezoidal walls comprising a third trapezoid attached along the width of the base at a third angle less than 90°, and;

a fourth trapezoid attached along the width of the base at a fourth angle less than 90°, wherein the first and second angles may be the same and the third angle is smaller than the fourth angle;

contacting the side attached to the base at the third angle to the user's shoulder blades;

contacting the user's buttocks and feet to the floor;

repeatedly raising the buttocks off the floor, leaving the shoulder blades in contact with the device and the feet in contact with the floor.

32. A method of conducting isometric exercise comprising:

providing an inflated trapezoidal-polyhedral exercise device;

contacting a first opposing side of the device to a first bilaterally symmetrical part of the user's body;

contacting a second opposing side of the device to a second bilaterally symmetrical part of the user's body, and;

exerting a muscular force on the device with a two bilaterally symmetrical parts of the user's body and holding such force for a predetermined time.

33. A method of conducting isometric exercise comprising:

providing the inflatable exercise device of claim 2;

contacting a the top of the device to the abdomen and chest of the user's body;

contacting the side forming the 55° angle to the upper legs of the user, and;

exerting a muscular force on the device by bending forward at the waist and holding such force for a predetermined time.

* * * * *